United States Patent [19]

Osmond et al.

[11] 3,996,023

[45] Dec. 7, 1976

[54] AVIATION FUEL CONTAINING DISSOLVED POLYMER AND HAVING REDUCED TENDENCY TO PARTICULATE DISSEMINATION UNDER SHOCK

[75] Inventors: Desmond Wilfrid John Osmond, Windsor; Norman Douglas Patrick Smith; Frederick Andrew Waite, both of Farnham Common, all of England

[73] Assignee: Imperial Chemical Industries Limited, London, England

[22] Filed: Apr. 22, 1969

[21] Appl. No.: 818,249

Related U.S. Application Data

[63] Continuation-in-part of Ser. No. 786,629, Dec. 24, 1968, abandoned, which is a continuation-in-part of Ser. No. 751,992, Aug. 12, 1968, abandoned.

[30] Foreign Application Priority Data

Dec. 20, 1968 United Kingdom ..... 60720/68
Apr. 11, 1968 United Kingdom ..... 17544/68

[52] U.S. Cl. ..... 44/62; 44/70; 44/71; 44/77; 44/80

[51] Int. Cl.[2] ..... C10L 1/16

[58] Field of Search ..... 44/53, 62, 70, 71, 77, 44/80

[56] References Cited

UNITED STATES PATENTS

| | | | |
|---|---|---|---|
| 3,013,868 | 12/1961 | Skei et al. | 44/62 |
| 3,126,260 | 3/1964 | Van Der Minne et al. | 44/62 |
| 3,136,743 | 6/1964 | Conway et al. | 252/56 R |
| 3,231,498 | 1/1966 | de Vries | 44/62 |
| 3,326,804 | 1/1967 | Shih-en Hu | 44/62 |
| 3,473,901 | 8/1969 | deBennevill et al. | 44/62 |

OTHER PUBLICATIONS

Kirk–Othmer, Encyclopedia of Chemical Technology, 2nd Ed., vol. 15, 1968, p. 87.

Tanford, Physical Chemistry of Macromolecules, Wiley 1961, pp. 165–168, 174–178, 198–200, 402–406.

Miller, The Structure of Polymers, Reinhold 1966, pp. 190–193, 213, 214.

Porter et al., "The Entanglement Concept in Polymer Systems", in Chemical Reviews, vol. 66, No. 1, 1966, pp. 1–4, 13.

Cohen et al., Journal of Polymer Science, vol. 49, 1961, pp. 377–383.

Flory, Principles of Polymer Chemistry, Cornell U. 1953, pp. 610–611.

Def. Pub. T–858,018, Jacobson, N., *Multifunctional Polymeric Additive for Mineral Oils*, Jan. 21, 1969, Application Ser. No. 664,925

*Primary Examiner*—W. J. Shine
*Attorney, Agent, or Firm*—Cushman, Darby & Cushman

[57] ABSTRACT

A polymer is dissolved in a liquid hydrocarbon fuel which has a flash point of at least 90° F and is of a type suitable for gas turbine aircraft engines in order to reduce the tendency of the fuel to particulate dissemination when the fuel is subjected to shock. The polymer has a viscosity average molecular weight greater than $10^6$ or an intrinsic viscosity greater than 2.5 dls./gm. and the amount of polymer is sufficient that there is molecular overlap of polymer molécules in the liquid.

9 Claims, 3 Drawing Figures

Figure 1:
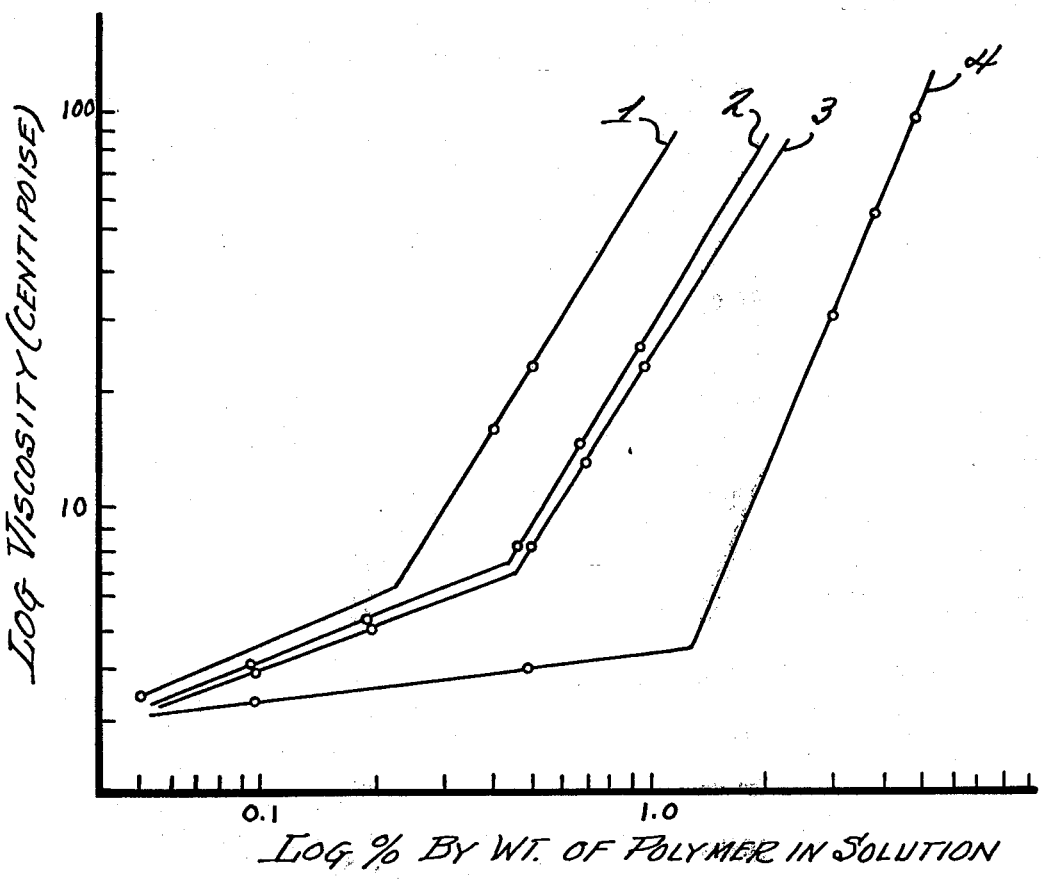

INVENTORS
DESMOND WILFRED JOHN OSMOND
NORMAN DOUGLAS PATRICK SMITH
FREDERICK ANDREW WAITE
BY

ATTORNEYS

INVENTORS
DESMOND WILFRED JOHN OSMOND
NORMAN DOUGLAS PATRICK SMITH
FREDERICK ANDREW WAITE
BY

ATTORNEYS

INVENTORS
DESMOND WILFRED JOHN OSMOND
NORMAN DOUGLAS PATRICK SMITH
FREDERICK ANDREW WAITE
BY

ATTORNEYS

AVIATION FUEL CONTAINING DISSOLVED POLYMER AND HAVING REDUCED TENDENCY TO PARTICULATE DISSEMINATION UNDER SHOCK

This application is a continuation-in-part of prior U.S. application Ser. No. 786,629 filed Dec. 24, 1968 which in turn is a continuation-in-part of prior U.S. application Ser. No. 751,992, filed Aug. 12, 1968, both of said prior applications now being abandoned.

This invention relates to the control of dissemination of liquids when such liquids are subjected to shock, and more particularly to improved aircraft fuels.

It is known that when a liquid with a free surface is subjected to conditions of shock there is a tendency for the liquid to become disseminated in particulate form and that the effect of shock may be such as to convert a proporation of the liquid into a dispersion of fine liquid droplets in air, i.e. a mist.

It is very desirable to be able to control the extent to which such a dispersion or mist of liquid is formed under shock conditions since, for example, this mist if inflammable may constitute a hazard. A situation in which it is most important to keep to a minimum the formation of such mist under shock conditions is the crash of an aircraft carrying inflammable liquid, such as its fuel. Though hydrocarbon fuels now used for aircraft gas turbine engines may be of a higher flash point than aviation gasoline as used in spark-ignition engines with a consequent reduction in the risk of fire due to ignition of vapour, mists of fuels with flash points of 90° F. and higher are still highly susceptible to ignition by flames, electrical sparking or the effect of friction, as well as by the presence of hot metal in the engines, and so there is still a considerable fire hazard immediately after a crash of an aircraft using such fuel. Furthermore, there is the risk of propagation of fire to the bulk of liquid fuel even if little damage is caused by ignition of the mist itself.

It is an object of this invention therefore to reduce the tendency to particulate dissemination on being subjected to shock, of a liquid hydrocarbon fuel suitable for use in gas turbine engined aircraft and having a flash point of at least 90° F.

We have now found that when such a liquid hydrocarbon fuel having a free surface is subjected to conditions of shock as herein described, the particulate dissemination of the liquid is reduced when there is dissolved in the liquid a polymer of molecular weight greater than $1 \times 10^6$ (viscosity average) or of intrinsic viscosity greater than 2.5 dls./gm. in a concentration such that there is molecular overlap of the dissolved polymer.

The term "molecular overlap" describe the condition in which the segment density of the dissolved polymer in the liquid is substantially uniform on a molecular scale. This condition corresponds to concentrations at and above that at which the centres of mass of the polymer molecules are spaced, on average, at twice the radius of gyration of the polymer molecules. At lower concentrations the polymer molecules may be partially overlapped but the segment density on a molecular scale varies between a maximum value at the centre of mass of a molecule and a minimum value midway between the centres of mass of adjacent molecules.

The segment density distributions in individual polymer molecules are known or can be calculated by formula as given in "Physical Chemistry of Macromolecules" by Tanford (John Wiley, 1963) p. 176. Consequently the lowest concentration at which molecular overlap occurs can be calculated. Where intrinsic viscosity rather than molecular weight is known an alternative calculation can be made using the formula given in "Polymer Chemistry" by Flory (Cornell U.P. 1953) p. 611. Further, the lowest concentration at which this condition occurs may also be determined by plotting on log/log scales the apparent viscosity at zero rate of shear of polymer solutions against polymer concentration by weight. We find that such plots in the region of the concentration at which the desired molecular overlap first occurs, i.e. in the region 0.01 to 1% of polymer, consist essentially of two straight lines intersecting at the critical concentration.

By the expression "subjected to conditions of shock" we mean subjected to external forces operating for only a short time, i.e. to impulses as understood in classical applied mathematics, such that the shape of the liquid undergoes rapid deformation.

Typical conditions of shock may arise for example from:

a. the impact of a falling or projected mass of the liquid with a rigid surface;
b. the impingement of a solid or liquid mass on a free surface of the liquid;
c. the application of a force to a wall of an open or vented container for the liquid such as to produce transient deformation of the container;
d. the direct exposure of a free surface of the liquid to a rapid fluid flow, for example when a stream of the liquid is ejected into a turbulent air stream.

In these conditions of shock the liquid is subjected to a high rate of increase in rate of shear.

Liquids having a surface tension less than or not substantially greater than that of water and which have a viscosity less than 10 poises, and especially less than 1 poise, when subjected to shock conditions as defined, may produce substantially quantities of finely divided droplets from a free surface even when the shock is as little as that produced in dropping a sample, say 5 gms., of the liquid from a height of several inches onto a rigid surface. By means of this invention a reduction in dissemination of the said liquid hydrocarbon fuel may be obtained under such mild conditions of shock and under much more severe conditions.

Liquid hydrocarbon fuels suitable for use in gas turbine engined aircraft contain antioxidants such as:

a. N,N′-diisopropyl-para-phenylenediamine
b. N,N′-disecondary butyl-para-phenylenediamine
c. 2,6-ditertiary butyl-4-methylphenol
d. 2,4-dimethyl-6-tertiary butylphenol
e. 2,6-ditertiary butylphenol
f. 75% min. 2,6-ditertiary butylphenol
   25% max. tertiary and tritertiary butylphenols
g. 72% min. 2,4-dimethyl-6-tertiary butylphenol
   28% max. monomethyl and dimethyl tertiary butylphenol
h. 65% min. N,N′-disecondary butyl-para-phenylenediamine
   35% max. N,N′-disecondary butyl-ortho-phenylenediamine These materials are usually present in a proportion of not more than 24 mg./liter and preferably at least 8.6 mg./liter.

The fuel may also contain:

metal deactivator such as N,N′-disalicylidene-1,2 propane diamine in amount not exceeding 5.8 mg./liter;

corrosion inhibitor. A relevant U.S. Military Specification for fuel-soluble corrosion inhibitors is MIL-I-25017;

icing inhibitor, such as ethylene glycol monomethyl ether or a mixture thereof with glycerol. A suitable proportion is from 0.10 to 0.15% by volume of the fuel. A relevant U.S. Military Specification for fuel system icing inhibitors is MIL-I-27686;

antistatic additive such as Shell Antistatic Additive ASA-3 in a concentration not exceeding 1.0 p.p.m. By use of this additive the electrical conductivity of the fuel may be brought within the range 50 – 300 picomhos/meter.

For use in this invention the liquid hydrocarbon fuel should have a flash point of at least 90° F. as determined by Test Method ASTM Standard D93.

Suitable liquid hydrocarbon fuels to which this invention may be applied include Aviation Turbine Fuels Grade JP-8 (flash point 110° F. min.) as specified in U.S. Military Specification MIL-T-83133, Grade JP-5 (flash point 140° F. min.) as specified in U.S. Military Specification MIL-T-5624G, Grades Jet A and Jet A-1 (flash point 110° F. min.) as specified in ASTM Specification D.1655/66T and Grade AVTUR - NATO Code No. F-35 (flash point 100° F. min.) as specified in U.K. Ministry of Aviation Specification No. D. Eng. R. D. 2494 (Issue 4).

The nature of the polymer to be dissolved in the liquid hydrocarbon fuel which may be subjected to shock conditions is limited primarily by its molecular weight and we find that in order to influence the other characteristics of the liquid to a minimum extent and to reduce dissemination over the widest range of shock conditions the molecular weight should be greater than $1 \times 10^6$ (viscosity average). In the case of hydrocarbon polymers, this lower limiting molecular weight of $1 \times 10^6$ (viscosity average) corresponds to an intrinsic viscosity of 2.5 dls./gm. as determined in a hydrocarbon liquid in which the polymer is soluble at 25° C., and in the case of polymers for which the constants necessary for the calculation of viscosity average molecular weight are not readily available this value of intrinsic viscosity may be accepted as a corresponding lower limit.

In view of the requirement for high molecular weight the most suitable polymers are those prepared by addition polymerisation (in which expression we include the polymerisation of the alkylene oxides and similar types of polymerisation) using free-radical, ionic, Ziegler and other types of initiators.

Since liquid hydrocarbon fuels are non-polar, polymers to be dissolved in them should also be non-polar and non-crystalline. Suitable polymers include non-polar polymers derived from ethylenically unsaturated ethers containing alkyl groups of at least $C_4$, e.g. vinyl isobutyl ether and vinyl octyl ether, and from ethylenically unsaturated esters containing alkyl groups of at least $C_8$, e.g. 2-ethylhexyl acrylate, octyl, cetyl and lauryl methacrylates, vinyl stearate and vinyl octoate. The larger alkyl groups in the ester monomers, as compared with those in the ether monomers, are required in order to impart suitable solubility characteristics to the polymer. Preferably the alkyl groups in the ester monomers are of $C_{12} - C_{16}$ and in the ether monomers are of $C_4 - C_8$.

The most suitable polymers however are non-crystalline polymers which are devoid, or substantially devoid, of polar groups such as ester or ether groups, i.e. polymers derived from ethylenically unsaturated hydrocarbons such as isobutylene, butadine, isoprene and mixtures of ethylene and propylene. Polystyrene alkylated with alkyl groups of at least $C_4$ and preferably at least $C_8$ may also be used. Linear polyethylene would be the most efficient polymer, having the longest chain length per unit weight, except that because of its crystallinity, it is not adequately soluble in hydrocarbon liquids. However, non-crystalline polymers can be produced by copolymerising ethylene and propylene; polymers of this type may contain 10 – 80% by weight of propylene but preferably contain from 18 – 25% by weight of propylene. The polymer may optionally contain a minor proportion, preferably not more than 15% by weight, of higher olefins such as pentenes, hexenes and higher homologues but these of course tend to reduce the chain length/weight ratio.

In general the solubility of the polymer in the liquid hydrocarbon fuel should be such that the theta-temperature of the system is below the temperature to which the solution is likely to be subjected, otherwise there is a danger of precipitation of the polymer. The polymer-solvent relationship at the theta-temperature is discussed by P. J. Flory in "Principles of Polymer Chemistry" at pages 612–615. In jet aircraft the lowest temperature to which the fuel is likely to be subjected is about −50° C.

It is an advantage that when the dissemination of the liquid need no longer be reduced, for example when a liquid fuel is to be sprayed into the combustion chamber of a gas turbine engine, the molecules of the polymer used in the invention may be readily reduced in molecular weight by a suitable degradation process, for example by mechanical shearing, or disentangled by shear thinning. Such treatment, leading to a decrease in control of dissemination of the liquid may be carried out in the engine itself or at an earlier stage in the feed line to the engine.

It is also an advantage that the polymers are normally inert and are used in such minor concentration that they have a minimal effect on the important characteristics of the liquid fuel, for example, the calorific value and non-gumming and non-corrosive characteristics.

The concentration of polymer dissolved in the liquid hydrocarbon fuel is broadly determined by the requirement that there should be molecular overlap of the dissolved polymer. In practice one way in which the desired minimum concentration at which this condition exists may be experimentally determined is by measuring the viscosity of a range of solution of a polymer in the liquid over a range of shear rates. Suitable apparatus to use for this measure is a Contraves Rheomet or a Weissenburg Rheogoniometer. An apparent viscosity at zero shear rate is then obtained by arbitrarily extrapolating the values at each polymer concentration to zero shear rate, these values then being plotted again the corresponding concentration. Such plots, when on log/log scales, consist essentially of two straight line portions, the intersection of which shows up a critical region of concentration for each molecular weight in which a more rapid increase in viscosity begins to take place.

We have found that when the polymer has a molecular weight of above $1 \times 10^6$ (viscosity average) or an intrinsic viscosity of greater than 2.5 dls./gm. a marked reduction in shock dissemination of the solution is obtainable at polymer concentrations as low as those in these critical regions where there is an upturn in the log/log plots of viscosity (apparent at zero shear rate) against concentration. It is known of course that shock dissemination of liquids can be reduced by drastically increasing their viscosity but the surprising result of application of this invention is that a significant reduction in shock dissemination is obtainable long before the equilibrium low shear viscosity of the solution has been raised to the high value one would expect to need to reduce shock dissemination of the solution. The resistance of the liquid to shock dissemination increases as the proportion of polymer dissolved therein increases but so does the equilibrium low shear rate viscosity of the liquid until it reaches a point where significant resistance to shock dissemination would be expected simply because this viscosity value is sufficiently high. Using the selected polymers of this invention a marked reduction in shock dissemination of liquids can be obtained when the solution of the polymer in the liquid has an equilibrium low shear rate viscosity of less than 100 centipoises.

The proportion of polymer required in any particular case will depend on its molecular weight; the higher the molecular weight of the polymer, the lower will be the porportion of the polymer required to achieve a specified anti-misting effect. As stated above, the reduction in shock dissemination begins at concentrations corresponding to about the upturn in the log/log plot of viscosity (apparent viscosity at zero shear rate) against concentration and increases thereafter.

We have found that a useful empirical test which gives an approximate indication of the concentration at which this upturn in viscosity, resulting from molecular overlap of the polymer molecules in the solution which results in the reduction in shock dissemination of the liquid, is one in which a thin stream of the solution is dropped into the centre of a hollow cylindrical metal vessel the wall of which is lined with absorbent paper. Any splashes of liquid falling on the paper can readily be detected if a small quantity of soluble dye is added to the solution. If a 10 ml. sample of the solution is dropped in a thin stream from a height of 2 meters into such a vessel 17 cm. in diameter and 21 cm. high then the minimum polymer concentration at which no liquid splashes onto the paper lining the wall corresponds approximately to the upturn concentration on the log/log viscosity/concentration curve of the solution, i.e. the minimum concentration for molecular overlap.

This is the minimum useful anti-misting concentration of any polymer and we have found that in practice the most useful concentrations lie in the range 1.5–15 times this minimum and preferably are about 2 – 10 times this minimum.

As a general indication of practically useful concentration ranges, a polymer of molecular weight (viscosity average) about $1 \times 10^7$ (corresponding to an intrinsic viscosity of about 10 dls./gm.) has a useful effect in aircraft fuels at a concentration of as low as 0.05% by weight whereas in the case of a polymer of visosity average molecular weight about $10^6$ (corresponding to an intrinsic viscosity of about 2.5 dls./gm.) a concentration of about 1% by weight is desirable. Preferably the aircraft fuels of this invention contain from 0.1 to 2% by weight of an appropriate polymer of molecular weight (viscosity average) at least $1 \times 10^6$ or of intrinsic viscosity at least 2.5 dls./gm.

High molecular weight polymers usually are a mixture of polymers of a range of molecular weight or intrinsic viscosities, a range which is sometimes very wide. However, this invention makes use of the effect of polymers of viscosity molecular weight greater than $1 \times 10^6$ or of intrinsic viscosity greater than 2.5 dls./gm. and although these selected polymers are effective and can be used in the presence of polymer of lower molecular weight or intrinsic viscosity the lower polymers cause an increase in viscosity of the liquid without the same beneficial effect on resistance to shock dissemination as the higher polymers.

When dissolving polymer in the liquid care should be taken to avoid degradation of the polymer.

The soluble polymers of this invention may, if desired, be employed in conjunction with particulate dispersions or other methods of liquid modification or gelatin may be employed without losing the benefits of the invention.

The invention is illustrated by the following examples in which all proportions and percentages are by weight.

EXAMPLE 1

A sample of solid commercial polyisobutylene having a viscosity average molecular weight of 4,700,000 and an intrinsic viscosity of 6.5 was dissolved in aliphatic hydrocarbon solvent (boiling range 230°–250° C. Flash point 130° F) with the aid of a masticator to give a 10% solution, based on the weight of solvent. Portions of this solution were carefully diluted to give a range of solutions with concentrations 0.05 to 1.0% of polymer. The viscosities of each solution were measured on a cone and cylinder viscometer at shear rates covering the span 20 – 2000 sec.$^{-1}$. In each case the viscosity was plotted against shear rate and the viscosity curve arbitrarily extrapolated to zero shear rate. The zero shear rate viscosities were then plotted against concentration on log/log scales to produce curve 1, FIG. 1.

The "misting" characteristic of the solutions and the unmodified solvent were tested by dropping 10 ml. samples in a thin stream from a height of 2 meters into a hollow cylindrical vessel diameter 17 cm. and height 21 cm. having its sides lined with absorbent paper. In order to facilitate observation a small quantity of soluble dye was added to each sample. The density and size of the spots produced on the paper by droplets splashed from the solutions in a selected area of the paper gave a comparison of the dissemination of the liquids by impact with the base of the vessel.

| Conc. of polymer % wt. of liquid | Zero shear visc. in centipoises | Density of spots (per square inch) | Size of spots (diameter in mm.) |
|---|---|---|---|
| 0.0 | 2.3 | ~1000 | Majority ~ 1 mm. considerable overlap |
| 0.05 | 3.5 | 20 | 1 – 3 mm. |
| 0.1 | 4.0 | 3 | 4 mm. |
| 0.2 | 6.0 | NIL | — |
| 0.3 | 8.0 | NIL | — |
| 0.5 | 16.0 | NIL | — |
| 1.0 | | NIL | — |

By comparing the results in the Table with the curve 1 in FIG. 1 it will be seen that the lowest concentration at which droplet formation is suppressed is approximately the same as the concentration at which the abnormal viscosity begins to occur which in turn coincides with the lowest concentration at which there is molecular overlap of the polymer molecules as calculated from published data and mathematical formulae.

(See Tanford "Physical Chemistry of Macromolecules", page 176. John Wiley 1963).

The tests were repeated using a sample of solid commercial polyisobutylene having a viscosity average molecular weight of 2,700,000 and an intrinsic viscosity of 4.5 dissolved in the same grade of aliphatic hydrocarbon and a viscosity/concentration curve (3, FIG. 1) constructed as before. The misting characteristics of the solutions were similarly determined by the empirical test.

| Conc. of polymer % wt. of liquid | Zero shear visc. in centipoises | Density of spots (per square inch) | Size of spots (diameter in mm.) |
|---|---|---|---|
| 0.0 | 2.3 | ~1000 | Majority ~ 1 Considerable Overlap |
| 0.1 | 4.0 | 30 | 2 (with some larger) |
| 0.2 | 5.0 | 10 | 2 and 5 (in equal number proportion) |
| 0.3 | 6.0 | 3 | 5 + |
| 0.4 | 7.5 | NIL | — |
| 0.5 | 9.2 | NIL | — |
| 1.0 | 20.0 | NIL | — |

By comparing the results in the table with the curve 3 in FIG. 1 it will be seen that the lowest concentration at which droplet formation is suppressed in approximately the same as the concentration at which abnormal viscosity begins to occur.

The equilibrium low (zero) shear rate viscosity of these solutions as determined by viscosity measurement at various shear rates and extrapolation to zero shear rate is shown in the second column of the table. Clearly these viscosities are well below the value normally required, e.g. when using low molecular weight polymers as thickners, to suppress droplet formation.

The solutions could be pumped and stored in aircraft fuel tanks and transferred along feed lines. They could also be burned in aircraft gas turbine engines through, due to different spray characteristics, modification of spray pumps and nozzles was desirable for satisfactory combustion under every circumstance.

By way of comparison a sample of solid commercial polyisobutylene having a viscosity average molecular weight of 380,000 and an intrinsic viscosity of 1.25 was dissolved in the same grade of aliphatic hydrocarbon used before and the concentration range was extended to 5% to produce curve 4, FIG. 1. Even at 5% concentration of polymer and a viscosity of 90 centipoises the solution gave a pattern of spots of diameter approximately 1 – 5 mm. when subjected to the misting test. The viscosity concentration curve 4 does deviate from ideality but the deviation is relatively smooth indicating that because the absolute molecular weight of the polymer is low the diffusion half-life for disentanglement is also low so that although some reduction in misting is achieved at high concentration this is achieved only with a correspondingly large increase in viscosity. In fact, droplet suppression was only achieved at a polymer concentration of about 8% corresponding to an equilibrium low (zero) shear rate viscosity of several hundred centipoises.

EXAMPLE 2

Poly-2-ethyl hexyl acrylate of viscosity average molecular weight 5,000,000 was prepared by a redox-initiated emulsion polymerisation at room temperature. The polymer was dissolved in aliphatic hydrocarbon (boiling range 230° – 250° C. flash point 130° F.) by adding the emulsion dropwise to a 10:1 mixture of the aliphatic hydrocarbon and cyclohexane (B.p. 83° C.) held at 120° C. at such a rate that there was no build up of water or bulk polymer in solution, and in such amount that in the absence of the cyclohexane there would be present 10% by weight of polymer based on the weight of solvent. The solution was diluted and tested as in Example 1. The concentration viscosity curve (curve 2 in FIG. 1) and the results of the misting test were similar to those of the second high molecular weight polymer used in Example 1.

Similar results were obtained using a 98/2 copolymer of 2-ethyl hexyl acrylate and acrylic acid having a viscosity average molecular weight of 5,000,000.

EXAMPLE 3

Figure 2:
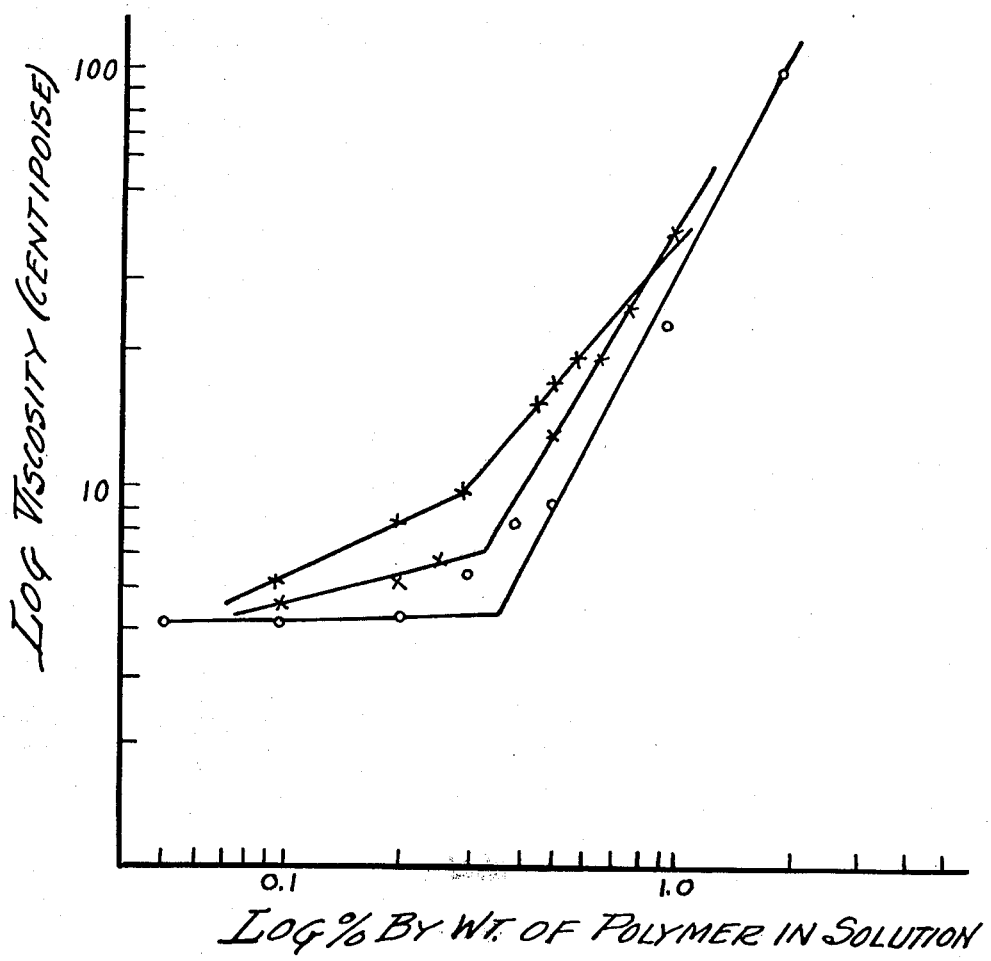

When the test described in Example 1 was applied to solutions in the aliphatic hydrocarbon solvent (boiling range 230° – 250° C. flash point 130° F.) of ethylene/propylene rubber of molecular weight $10^7$(viscosity average) and intrinsic viscosity 5.4, the spot density was reduced to nil at 1% concentration of the rubber. Using ethylene/propylene rubbers of intrinsic viscosity 3.4 and 3.7, the spot density was reduced to nil at 2% concentration of the rubber. The viscosity concentration curve of the rubber of intrinsic viscosity 3.4 is curve 5 of FIG. 2.

EXAMPLE 4

When the test described in Example 1 was applied to solutions in the aliphatic hydrocarbon solvent (boiling range 230° – 250° C. flash point 130° F.) of polyisoprene of molecular weight $2 \times 10^6$ (viscosity average) and intrinsic viscosity 6.8 the spot density was reduced to nil at 0.5% concentration of the polymer. The viscosity/concentration curve of the polyisoprene is curve 6 of FIG. 2.

EXAMPLE 5

When the test described in Example 1 was applied to solutions in the aliphatic hydrocarbon solvent (boiling range 230° – 250° C., flash point 130° F.) of natural rubber of intrinsic viscosity 5.6 the spot density was reduced to nil at 0.5% concentration of the rubber. The viscosity/concentration curve of the rubber is curve 7 of FIG. 2.

EXAMPLE 6

When the test described in Example 1 was applied to solutions in the aliphatic hydrocarbon solvent (boiling range 230° – 250° F., flash point 130° C.) of an ethylene/propylene terpolymer of intrinsic viscosity 4.25 the spot density was reduced to nil at 1.99% concentration of the polymer.

The solutions of polymer in hydrocarbon liquids described in Examples 2 – 6 could be used as fuels in gas turbine engines as described in Example 1.

For regular use in aircraft, aviation turbine fuels as described above can be modified in the same way by dissolving polymers of the specified high molecular weight therein to obtain molecular overlap of the dissolved polymers.

The aliphatic hydrocarbon used in the above Examples is similar to the aviation turbine fuel JP-5, the aviation turbine fuel having a somewhat wider boiling point range and, of course, containing the conventional anti-oxident additive and icing inhibitor.

EXAMPLES 7 – 12

The above Examples 1 – 6 were repeated by incorporating the same polymers in the same way into aviation turbine fuel JP-5; substantially the same results on plotting viscosities, carrying out the empirical test and burning in aircraft gas turbine engines were obtained. Natural rubber is not suitable in fuels for use at high altitudes, the theta temperature of the solution being only −10° C. Solutions of the other polymers had theta temperatures of lower than −40° C.

In the following Examples the liquid hydrocarbon was AVTUR aviation turbine fuel. Using this fuel, fire test were also carried out to check the reduction in shock dissemination against ignition behaviour. AVTUR is a critical fuel in such tests because of its relatively low flash point of about 100° F.

EXAMPLE 13

Polyisobutylene of viscosity average molecular weight 4,700,000 as used in Example 1 was dissolved in AVTUR fuel and a range of solutions of concentration from 0.05 to 1.0% by weight of the polymer were made.

A viscosity/concentration graph plotted as described above showed an upturn at 0.2% polymer.

An empirical fire test was carried out by dropping a gallon of the fuel through a 2 inch diameter hole in a container suspended 15 ft. about a metal plate 0.75 ft. in diameter supported 1ft. above the ground. The metal plate was ringed with 6 flame sources also supported 1 ft. above the ground.

On dropping a gallon of unmodified AVTUR fuel it immediately burst into a huge ball of flame on hitting and splashing off the metal plate into the flame sources. When the test was repeated using the solutions of polyisobutylene in AVTUR it was found that at concentrations of 0.5% polymer and above, ignition of the fuel was completely suppressed even when the flame sources were close in to the edge of the metal plate.

EXAMPLE 14

An ethylene/propylene copolymer (21% propylene) of intrinsic viscosity 10.4 was dissolved in AVTUR in a range of concentrations from 0.01 to 0.5%.

In a viscosity/concentration plot as described above the upturn occurred at a concentration of 0.075%.

EXAMPLE 15

As mentioned above it is desirable to avoid degradation of the polymer when incorporating it into the fuel. Example 1 was therefore repeated taking particular care to avoid degradation at the dissolving stage.

The three polyisobutylenes described in Example 1 were dissolved in the aircraft fuel JP-5 by gently stirring the polymer in the fuel for a period of two weeks.

Figure 3:
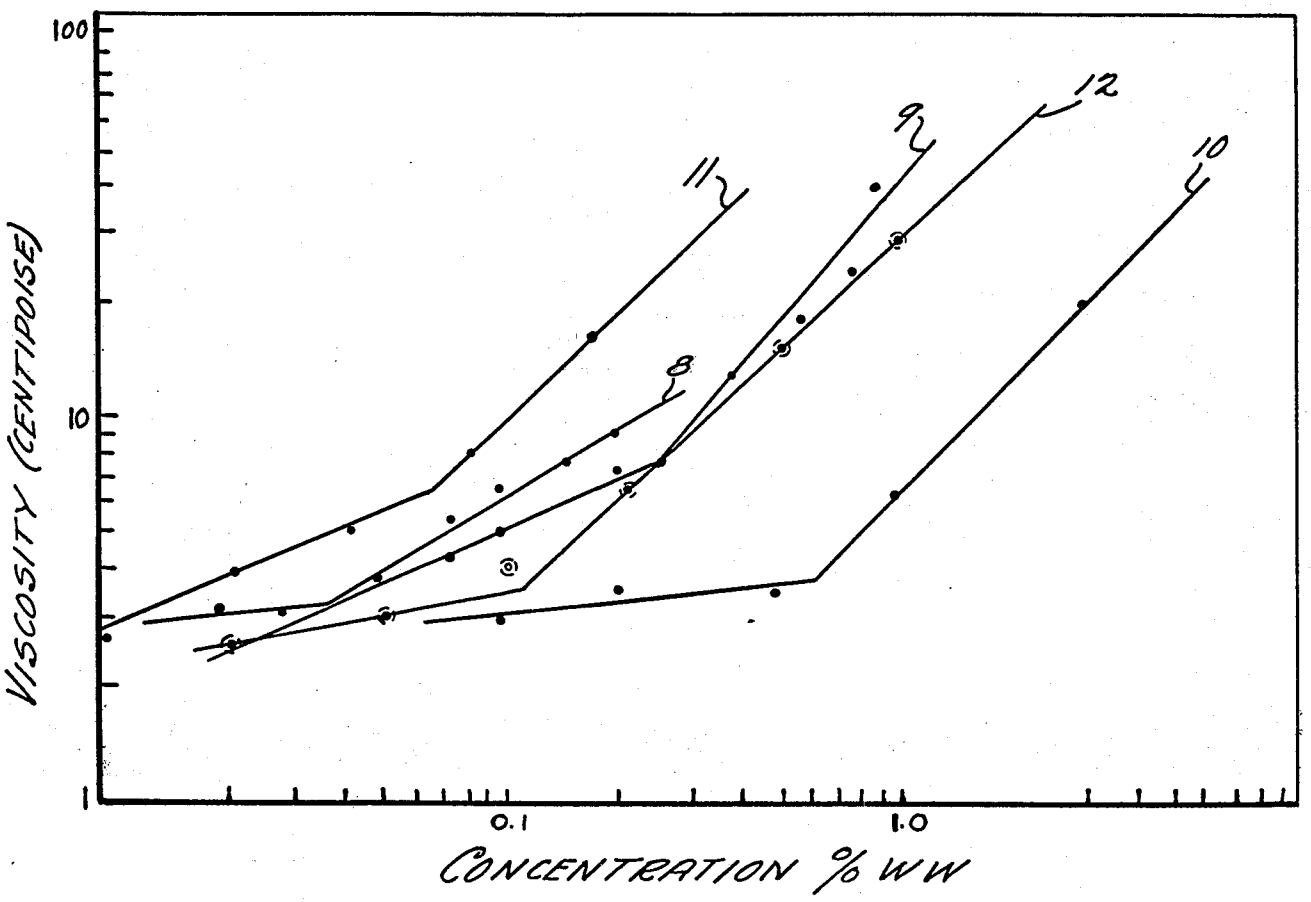

On repeating the viscosity measurements, plots shown in FIG. 3 of the accompanying drawings were obtained. Plot 8 corresponds to the solutions of polyisobutylene of molecular weight 4,700,000, Plot 9 to the solutions of polyisobutylene of molecular weight 2,700,000 and Plot 10 to the solutions of the comparative polymer of low molecular weight 380,000.

It will be seen that the upturns in the plots occur at the lower concentrations of 0.035%, 0.25%, and 0.7% respectively. Corresponding minima at which droplets were eliminated in the empirical splash test were 0.05%, 0.2% and 7.0% respectively.

EXAMPLE 16

When the ethylene/propylene polymer used in Example 14 was similarly dissolved in the aircraft fuel JP-5, the upturn in the viscosity/concentration plot (Plot 11 FIG. 3) was at 0.06% and droplet formation was eliminated in the empirical test at 0.02%.

EXAMPLE 17

When a polyvinyl butyl ether of intrinsic viscosity 4.5 was similarly dissolved in the aircraft fuel JP-5, the upturn in the viscosity/concentration plot (Plot 12 FIG. 3) was at 0.12% and droplet formation was eliminated in the empirical test at 0.1%.

EXAMPLE 18

A polystyrene of viscosity average molecular weight 5.7. $10^6$ and intrinsic viscosity 10 dls./gm. was alkylated with octan-2-ol to produce a product containing one octyl group per two phenyl groups. The product was dissolved in the aircraft fuel AVTUR and in the empirical splash test droplet formation was eliminated at a concentration of 0.06%.

We claim:

1. A liquid hydrocarbon fuel of flash point at least 90° F. and suitable for use in gas turbine engined aircraft, characterized in that it has a reduced tendency to particulate dissemination on being subjected to shock, the fuel containing dissolved therein an addition polymer of ethylenically unsaturated monomer which is soluble in said hydrocarbon fuel and which has a theta temperature lower than −50° C so that the polymer does not precipitate when the fuel is cooled to low temperature in an aircraft, said polymer having a viscosity average molecular weight greater than $10^6$ or of intrinsic viscosity greater than 2.5 dls./gm. in a concentration such that there is molecular overlap of the polymer molecules in the liquid.

2. A liquid fuel as claimed in claim 1 characterised in that the proportion of dissolved polymer is from 0.1 to 2% by weight of the liquid.

3. A liquid fuel as claimed in claim 1 characterized in that the proportion of polymer is from 1.5 to 15 times the proportion at which there is an upturn in the log/log plot of apparent viscosity at zero shear rate against polymer concentration in respect of solutions of said polymer in said liquid fuel, in the concentration range 0.01 to 1% by weight of polymer.

4. A liquid fuel as claimed in claim 1 characterized in that the proportion of polymer is from 2 to 10 times the proportion at which there is an upturn in the log/log plot of apparent viscosity at zero shear rate against polymer concentration in respect of solutions of said polymer in said liquid fuel, in the concentration range 0.01 to 1% by weight of polymer.

5. A liquid fuel as claimed in claim 1 characterized in that the polymer is derived from ethylenically unsaturated hydrocarbons.

6. A liquid fuel as claimed in claim 1 characterized in that the polymer is polyisobutylene.

7. A liquid fuel as claimed in claim 1 characterized in that the polymer is an ethylene/propylene copolymer.

8. A liquid fuel as claimed in claim 1 contained in a fuel tank of an aircraft.

9. A gas turbine engined aircraft characterized in that the fuel in the fuel tank thereof is a fuel as claimed in claim 1.

* * * * *